United States Patent [19]

Kavera et al.

[11] 4,026,530

[45] May 31, 1977

[54] CONTINUOUS ACTION MIXING APPARATUS FOR BULK MATERIALS

[76] Inventors: Alexandr Alexandrovich Kavera, ulitsa Bryanskaya, 2a, kv. 35; Anatoly Anatolievich Nitkovskikh, ulitsa Moskovskaya, 62, kv. 25; Anatoly Fedorovich Leontenko, ulitsa Temrjuxkaya, 64, kv. 53; Igor Longinovich Gaidar, ulitsa Karla Libknekhta, 133/1, all of Krasnodar, U.S.S.R.

[22] Filed: May 20, 1975

[21] Appl. No.: 579,065

[52] U.S. Cl. ..... 259/9; 259/68

[51] Int. Cl.[2] ..... B01F 7/10

[58] Field of Search ..... 259/9, 10, 25, 26, 45, 259/46, DIG. 11, 68, 69

[56] References Cited

UNITED STATES PATENTS

| | | | |
|---|---|---|---|
| 2,382,605 | 8/1945 | Carter, Jr. | 259/9 |
| 3,259,374 | 7/1966 | Doebl et al. | 259/10 |
| 3,684,458 | 8/1972 | McCammon et al. | 259/10 |
| 3,725,013 | 4/1973 | Kavera et al. | 259/10 |
| 3,843,100 | 10/1974 | Haas et al. | 259/9 |

*Primary Examiner*—Richard E. Aegerter
*Assistant Examiner*—Richard R. Stearns
*Attorney, Agent, or Firm*—Steinberg & Blake

[57] ABSTRACT

Continuous action mixing apparatus for bulk materials comprises a hollow horizontal cylindrical housing having an inlet port and outlet port for bulk material at the opposite ends thereof. The housing has mounted therein a horizontal driven shaft with tapering discs for mixing and conveying the bulk material, mounted on the shaft in spaced relationship and having their inner or concave surfaces facing the outlet port. Each disc has a blade formed on the outer or convex surface thereof and an opening provided therethrough in front of this blade in the direction of rotation of the disc. The blades and openings of adjacent discs are shifted relative to one another.

9 Claims, 3 Drawing Figures

CONTINUOUS ACTION MIXING APPARATUS FOR BULK MATERIALS

The invention relates to mixing apparatus for bulk materials, and particularly, to continuous action mixing apparatus operable with moistened granulated materials, such as granules of copolymer of styrene and divinylbenzene moistened with dichlorethane. The herein disclosed continuous action mixing apparatus can be also effectively used for mixing various brittle bulk materials in the pharmaceutical, food and other industries, as well as in agriculture, e.g. for disinfecting grain.

There is known a continuous action mixing apparatus including a horizontal cylindrical housing with the inlet and outlet ports at the opposite ends for charging and discharging the material, respectively. A horizontal driven shaft extends through the housing and supports thereon means for mixing and simultaneously conveying bulk material from the inlet to the outlet. The means for mixing and conveying bulk material are in the form of share-shaped blades. High quality of the mixing of bulk materials in mixers of the above-described type is attained, owing to intense centrifugal and swirl-like motion of the particles. The bulk materials charged into the inlet port are engaged by the rotating share-shaped blades which throw them with intensity sideways, the particles thus thrown deflecting from the walls and from the adjacent blades, whereafter they are engaged by the blades once more and again are thrown aside by the centrifugal forces. During this motion the particles repeatedly impact one another, as well as the walls and the mixing share-shaped blades.

The above specified character of the motion of the materials prohibits the use of the above-described mixing apparatus for mixing easily breakable materials, such as granules of copolymer of styrene and divinylbenzene moistened with dichlorethane. In the process of mixing and advancing of the granules longitudinally of the mixing apparatus they swell under the action of dichloroethane, and their surface softens. The active mixing and repeated impacts of the granules at high speeds against the walls of the housing and the mixing blades is liable to lead to attrition of the granules, to their deformation and even to their breakage, i.e. the quality of the final product is affected.

Furthermore, the homgeneity of the final product is affected by the spread in the dwell time of individual granules within the above-described known mixing apparatus and by the impossibility of ensuring their uniform dwell time. This might result in some of the granules quickly and unobstructedly passing to the outlet without having been able to swell under the action of the moistening substance, since in certain cases the swelling of granulated product takes a relatively long time, as long as an hour.

It is an object of the present invention to provide a continuous action mixing apparatus for bulk or fluent materials, which should ensure intense mixing of granules of the bulk material without their destruction throughout the dwell time of the granules in the mixing apparatus.

It is another object of the present invention to provide mixing apparatus for bulk materials, which should ensure uniform dwell time of the bulk material within the mixer.

These and other objects are attained in a continuous action mixing apparatus for fluent or bulk materials, comprising a hollow horizontal cylindrical housing with inlet and outlet ports at the opposite ends of the housing for charging and discharging bulk materials, respectively, and a driven shaft extending horizontally within the housing and carrying thereon means for mixing and simultaneously conveying the bulk material from the inlet port to the outlet port, in which apparatus, in accordance with the invention, the mixing means are in the form of a series of tapering discs mounted on the shaft throughout the length thereof and spaced from one another, the inner or concave surfaces of the discs facing the outlet port, each tapering disc being provided with a blade formed on the outer surface thereof and an opening situated in front of the blade in the direction of rotation of the tapering disc, the blades and the openings of adjacent tapering discs being shifted relative to one another.

This structure of the mixing apparatus provides for gradual pouring of the granules of the bulk material from the area of action of one tapering discs into the area of action of another one, the granules, thus pouring, intensely mixing without either destruction or attrition. The amount of moisture in the granules, e.g. the amount of dichlorethane, when granules of copolymer of styrene and divinylbenzene are treated, is averaged. The motion of the granules of a material in the herein disclosed mixing apparatus resembles the motion of the particles in intermittentaction mixers of the tumble drum type, and that with the process being continuous. Pouring intensely in the area of action of each tapering disc, the granules advance slowly along the mixing apparatus toward the outlet port. Quick passing of individual particles through the apparatus is prevented, which means that all the granules are given enough time for required swelling.

It is expedient that the peripheral ends of the blades should be bent at 90° in the direction of rotation of the tapering discs. This structure of the blades promotes the best and the fullest engagement of the granules of the material and prevents destruction of the granules getting into the gap between the edge of a blade and the wall of the housing.

It is further expedient that a partition should be mounted in the housing in front of the outlet port, the partition having an opening therethrough, and that a screw-type transportation impeller should be mounted in front of the partition. The provision of such a partition results in accumulation of the material in the mixing apparatus, the height of the opening through the partition determining the level of the material at the delivery end of the apparatus.

It is possible to additionally have at least one partition with an opening therethrough for passage of the bulk material, which should divide the housing into sections, a transportation screw-type impeller being mounted in front of the partition in the direction of the advance of the bulk material. With the help of such additional partitions it is possible to maintain a relatively permanent level of the material throughout the mixing apparatus, as well as to control the level of the material in the individual actions of the mixing apparatus.

The present invention will be further described in connection with its embodiments and the appended drawings, wherein.

Figure 1:
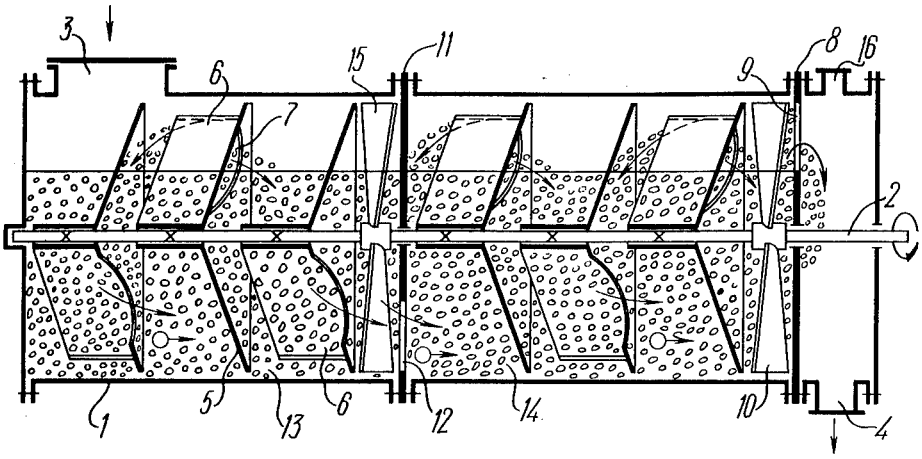
FIG. 1 is a schematic longitudinally sectional view of a continuous action mixing apparatus in accordance with the present invention.
Figure 2:
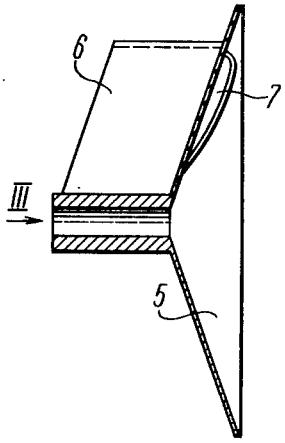
FIG. 2 is an enlarged longitudinally sectional view of the tapering disc in accordance with the invention.
Figure 3:
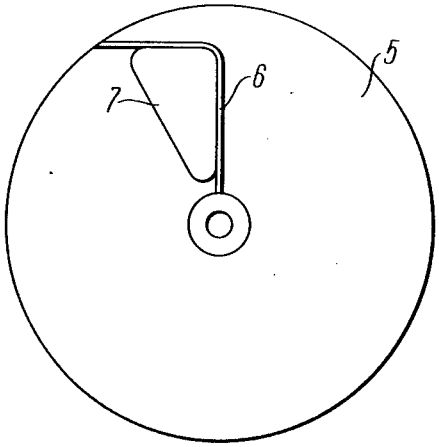
FIG. 3 is a view taken in the direction of arrow III in FIG. 2.

Referring now in particular to the appended drawings, the continuous action mixing apparatus includes a hollow horizontal cylindrical housing 1 (FIG. 1) and a driven horizontal shaft 2 extending through this housing. The housing 1 is provided with a charging means including inlet port 3 through which bulk material is charged into the apparatus and a discharging means including an outlet port 4 through which the material is discharged from the housing 1. The shaft 2 supports thereon means for mixing and simultaneously conveying the bulk material from the inlet port 3 to the outlet port 4, the means including a series of tapering discs 5 mounted on the shaft throughout the length thereof and spaced from one another, the inner or concave surfaces of the discs facing the outlet port 4. As is apparent from FIG. 1, the charging and discharging means respectively situated at the opposed ends of the housing 1 cooperate therewith to restrict the flow of material only into the housing 1 by way of the charging means and out of the housing 1 by way of the discharging means. Each disc 5 has blade 6 (FIGS. 1, 2) formed on the outer or convex surface thereof and an opening 7 (FIGS. 2, 3) made therethrough in front of the blade 6 in the direction of rotation of the disc 5. To ensure better engagement of the bulk material the peripheral ends of the blades 6 are bent at 90° in the direction of rotation of the discs 5, this direction being counterclockwise as viewed in FIG. 3.

The blades 6 and openings 7 of each adjacent pair of the discs 5 are offset relative to each other at a predetermined angle of which the value is selected in accordance with the required dwell time of the bulk material in the area of action of each respective disc 5 and can be as great as 270° or greater. In the mixing apparatus illustrated in FIG. 1 the angle of offset of the blades 6 and openings 7 of the adjacent discs 5 equals 180°.

There is mounted in front of the outlet port 4 within the housing 1 a partition 8 with an opening 9 therethrough, in front of which a screw impeller 10 for conveying the material is mounted on the shaft 2. The partition 8 provides for accumulation of the bulk material within the housing 1, while the height of the position of the opening 9 in the partition 8 determines the level of the bulk material at the outlet and of the mixing apparatus. There is also mounted within the housing 1 a transverse internal partition 11 with an opening 12 for passage of the bulk material therethrough, dividing the housing 1 into two sections 13 and 14. There is mounted in front of the partition 11 in the direction of the flow of the bulk material through the apparatus another conveying impeller screw 15. Several such partitions can be mounted in the apparatus to divide the housing 1 into sections, with the openings through these partions arranged at different levels, whereby a required level of the bulk material can be maintained in every section, and also a required volume of this material, the latter varying its volume during its advance through the housing 1, owing to swelling of the granules of the bulk material.

The housing is also provided with a connection 16 through which a liquid can be directed to wash away the bulk material, or else a blast of compressed air can be directed toward the outlet port to blow out the material "bridging" above the outlet port.

The herein disclosed mixing apparatus operates, as follows. Moistened bulk material, e.g. granules of copolymer of styrene and divinylbenzene pre-moistened with dichlorethane, is fed into the housing 1 via the inlet port 3 and thus gets into the area of the first tapering disc 5. With the shaft 2 rotating, the blade 6 of this tapering disc 5 engages the granules of the bulk material without damaging them and lifts them up, some of the granules thus lifted pouring through the opening 7 into the area of action of the second tapering disc 5 and the rest of the granules remaining in the area of action of the first disc 5, into which area a fresh amount of the bulk material has been already supplied. The granules within the area of action of the second tapering disc 5 are likewise lifted by the blade 6 of the latter and some of them pour through its opening 7 into the area of action of the third tapering disc 5, the rest of granules within the area of action of the second disc 5 pouring down to meet the granules which have poured into this area from the area of action of the previous tapering disc 5. Thus it will be seen, as indicated by the arrows in FIG. 1, that some granules are capable of freely flowing rearwardly through the open rear of blade 6 of the second disc 5 back into the area of action of the first disc, and of course in the same way granules from the third disc are capable of flowing rearwardly into the area of action of the second disc while some of the granules at the third disc of course advance toward the partition 11. After having been advanced to the partition 11, the granules flow through its opening 12 into the successive section 14 of the housing 1. While being thus advanced from the area of action of one tapering disc into the area of action of the next disc and from one section of the housing 1 into the next section, the granules of the bulk material follow an intricate path, being at the same time throughly mixed, the content of moisture therein being uniformly distributed. In the course of this advance and mixing the granules also swell uniformly. The dwell time of granules of the bulk material in the mixing apparatus is uniform, and their attrition and breakage, caused by their transportation by the tapering discs, are practically non-existent, which provides for obtaining a high-quality final product.

We claim:

1. A continuous action mixing apparatus for bulk materials, comprising: a hollow horizontal cylindrical housing; charging means including an inlet port for charging bulk material into said housing, said charging means being arranged at one end of housing; discharging means including an outlet port for discharging bulk material from said housing, said discharging means being arranged at the opposite end of said housing, said charging means and discharging means cooperating with said housing for restricting flow of bulk material only into said housing by way of said charging means and out of said housing by way of said discharging means; a horizontally oriented, rotatably driven shaft extending within said housing; a series of tapering discs mounted on said shaft throughout the length thereof in spaced relationship and having their inner surfaces facing said outlet port, said discs serving to mix bulk material and simultaneously to advance it in a direction from said inlet port to said outlet port; each tapering disc having a blade formed on the outer surface thereof and an opening provided therethrough in front of said blade in the direction of rotation of said tapering disc, said blades being open at rear portions thereof between each blade and the preceding disc, so that some of the bulk material can flow from the region of the blade of one disc back toward an area of action of the preceding disc.

2. A mixing apparatus as set forth in claim 1, wherein said blades of said tapering discs have the peripheral end portions thereof bent at 90° in the direction of rotation of said discs.

3. A mixing apparatus as set forth in claim 1, comprising: a partition with an opening therethrough, mounted in said housing in front of said outlet port; a material-conveying impeller screw mounted on said driven shaft in front of said partition.

4. A mixing apparatus as set forth in claim 1, comprising: at least one transverse partition mounted in said housing and dividing the internal space thereof into sections, said transverse partition having an opening made therethrough for passage of bulk material; a material-conveying impeller screw mounted on said driven shaft in front of said transverse partition in the direction of the advance of bulk material through said apparatus.

5. The combination of claim 1 and wherein said blade formed on the outer surface of each tapering disc is the only blade of each disc.

6. The combination of claim 1 and wherein said inlet port is the only port at said one end of said housing and said outlet port is the only port at said opposite end of said housing.

7. A continuous action mixing apparatus for bulk materials comprising: a hollow horizontal cylindrical housing; an inlet port for charging bulk material into said housing, arranged at one end of said housing; an outlet port for discharging bulk material from said housing, arranged at the opposite end of said housing; a horizontally oriented rotatably driven shaft extending within said housing; a series of tapering discs mounted on said shaft throughout the length thereof in spaced relationship and having their inner surfaces facing said outlet port, said discs serving to mix bulk material and simultaneously to advance it in a direction from said inlet port to said outlet port; each tapering disc having a blade formed on the outer surface thereof and an opening provided therethrough in front of said blade in the direction of rotation of said tapering disc, said blades being open at rear portions thereof between each blade and the preceding disc, so that some of the bulk material can flow from the region of the blade of one disc back toward an area of action of the preceding disc, said blades of said tapering discs having the periphal end portions thereof bent at 90° in the direction of rotation of said discs, each blade having adjacent a central region of each disc a substantially radial wall portion and each blade having at an outer end region of said substantially radial wall portion an outer wall portion extending substantially perpendicularly from said substantially radial wall portion, said opening in each disc being formed at the junction between the wall portions of each blade with each opening extending inwardly from said outer wall portion along said radial portion toward the central region of each disc.

8. The combination of claim 7 and wherein the blades and openings of successive discs are angularly offset one with respect to the next.

9. The combination of claim 7 and wherein a partition with an opening therethrough is mounted in said housing in front of said outlet port; a conveying impeller screw mounted on said driven shaft in front of said partition; at least one transverse partition mounted in said housing and dividing the internal space thereof into sections, said transverse partition having an opening made therethrough for passage of bulk material; a materialconveying impeller screw mounted on said driven shaft in front of said transverse partition in the direction of advance of bulk material through said apparatus, the opening in said partition in front of said outlet port being angularly offset with respect to the opening in said transverse partition dividing internal space of said housing into sections.

* * * * *